US008485248B2

(12) United States Patent
Coyle et al.

(10) Patent No.: US 8,485,248 B2
(45) Date of Patent: Jul. 16, 2013

(54) FLOW DISTRIBUTOR FOR A HEAT EXCHANGER ASSEMBLY

(75) Inventors: Brian J. Coyle, Orchard Park, NY (US); Sourav Chowdhury, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 264 days.

(21) Appl. No.: 12/965,976

(22) Filed: Dec. 13, 2010

(65) Prior Publication Data

US 2011/0139413 A1 Jun. 16, 2011

Related U.S. Application Data

(63) Continuation-in-part of application No. 12/637,960, filed on Dec. 15, 2009, now abandoned.

(51) Int. Cl.
*F28F 9/02* (2006.01)
*F28D 7/06* (2006.01)

(52) U.S. Cl.
USPC ..... 165/174; 165/175

(58) Field of Classification Search
CPC ..... F28F 9/0202; F28F 9/0204; F28F 9/0207; F28F 9/0209; F28F 9/0212; F28F 9/0214; F28F 9/0217
USPC ..... 165/174, 175, 176; 62/515
See application file for complete search history.

(56) References Cited

U.S. PATENT DOCUMENTS

| | | | | |
|---|---|---|---|---|
| 5,295,532 | A * | 3/1994 | Hughes | 165/76 |
| 5,590,710 | A * | 1/1997 | Sasaki et al. | 165/173 |
| 6,727,881 | B1 | 4/2004 | Albert et al. | |
| 7,971,636 | B2 * | 7/2011 | Higashiyama et al. | 165/174 |
| 2002/0066553 | A1 * | 6/2002 | Fischer et al. | 165/174 |
| 2003/0221819 | A1 * | 12/2003 | Jang | 165/173 |
| 2005/0172664 | A1 * | 8/2005 | Cho et al. | 62/515 |
| 2005/0247443 | A1 * | 11/2005 | Kim | 165/176 |
| 2007/0074861 | A1 * | 4/2007 | Higashiyama | 165/174 |

* cited by examiner

*Primary Examiner* — Tho V Duong
(74) *Attorney, Agent, or Firm* — James M. Chan

(57) ABSTRACT

A heat exchanger including a pair of manifolds. An inlet is disposed on one of the ends of the first manifold. A core extends between the manifolds for conveying a coolant therebetween and for transferring heat between the coolant and a stream of air. A cross-over plate is disposed in one of the manifolds to divide the associated one of the manifolds into an upstream section and a downstream section. The cross-over plate presents a plurality of orifices defining a cross-over opening area for establishing fluid communication between the upstream and downstream sections of the associated manifold. The cross-over opening area continuously increases along an axis away from the inlet. The total cross-over opening area is 30% to 300% of the upstream cross-sectional area of the tubes of the core.

3 Claims, 8 Drawing Sheets

FLOW DISTRIBUTOR FOR A HEAT EXCHANGER ASSEMBLY

RELATED APPLICATIONS

This is a continuation-in-part of U.S. Ser. No. 12/637,960, filed Dec. 15, 2009, entitled FLOW DISTRIBUTOR FOR A HEAT EXCHANGER ASSEMBLY, and assigned to the assignee of the present invention.

BACKGROUND OF THE INVENTION

A heat exchanger assembly for transferring heat between a coolant and a stream of air.

U.S. Pat. No. 6,272,881, issued to Kuroyanago et al. on Aug. 14, 2001 (hereinafter referred to as Kuroyanago '881), shows first and second manifolds spaced from one another A cross-over plate is disposed in one of the manifolds for dividing the associated manifold into an upstream section on one side of the cross-over plate and a downstream section on the other side of the cross-over plate. The cross-over plate defines at least one orifice for establishing fluid communication between the upstream and downstream sections of the associated manifold. A core extends between the first and second manifolds for transferring heat between the stream of air and the coolant. The core includes a plurality of tubes defining a plurality of upstream flow paths and a plurality of downstream paths. The upstream flow paths of the tubes are in fluid communication with the upstream section of the one of the manifolds including the cross-over plate, and the downstream flow paths of the tubes are in fluid communication with the downstream section of the one of the manifolds including the cross-over plate. The upstream flow paths define an upstream cross-sectional area, and the downstream flow paths define a downstream cross-sectional area. The orifices of the cross-over plate define a cross-over opening area.

SUMMARY OF THE INVENTION AND ADVANTAGES

The invention provides for such a heat exchanger assembly and wherein the cross-over opening area of the cross-over plate is 30% to 100% of the upstream cross-sectional area of the upstream flow paths. This ratio maximizes the efficiency of the heat exchanger assembly by ensuring optimum fluid flow without creating an pressure drop in the coolant flowing through the cross-over plate. A large pressure drop often has the undesirable effect of cooling and/or re-condensing the coolant.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
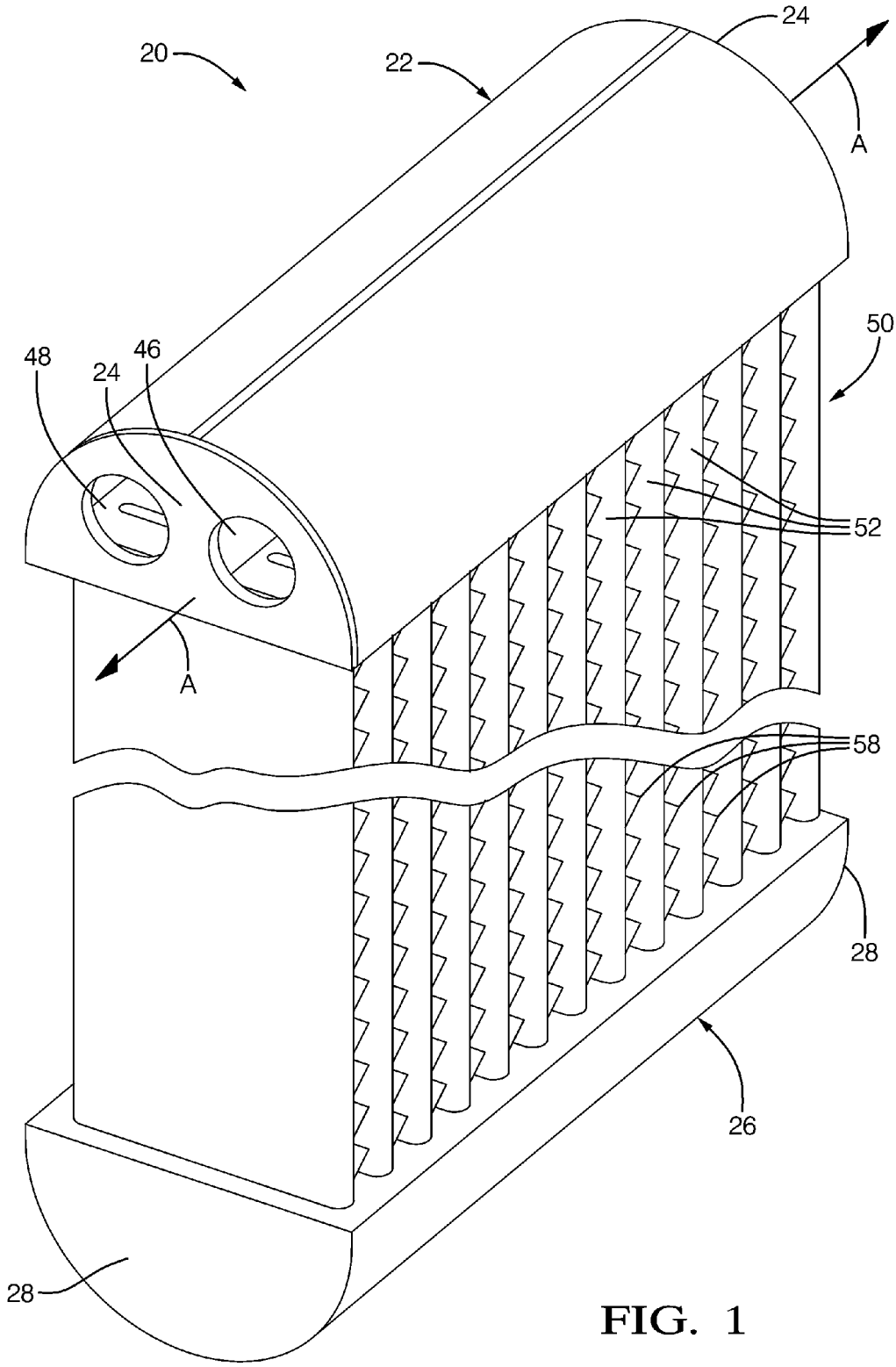
FIG. 1 is a perspective view of the subject invention.
Figure 2:
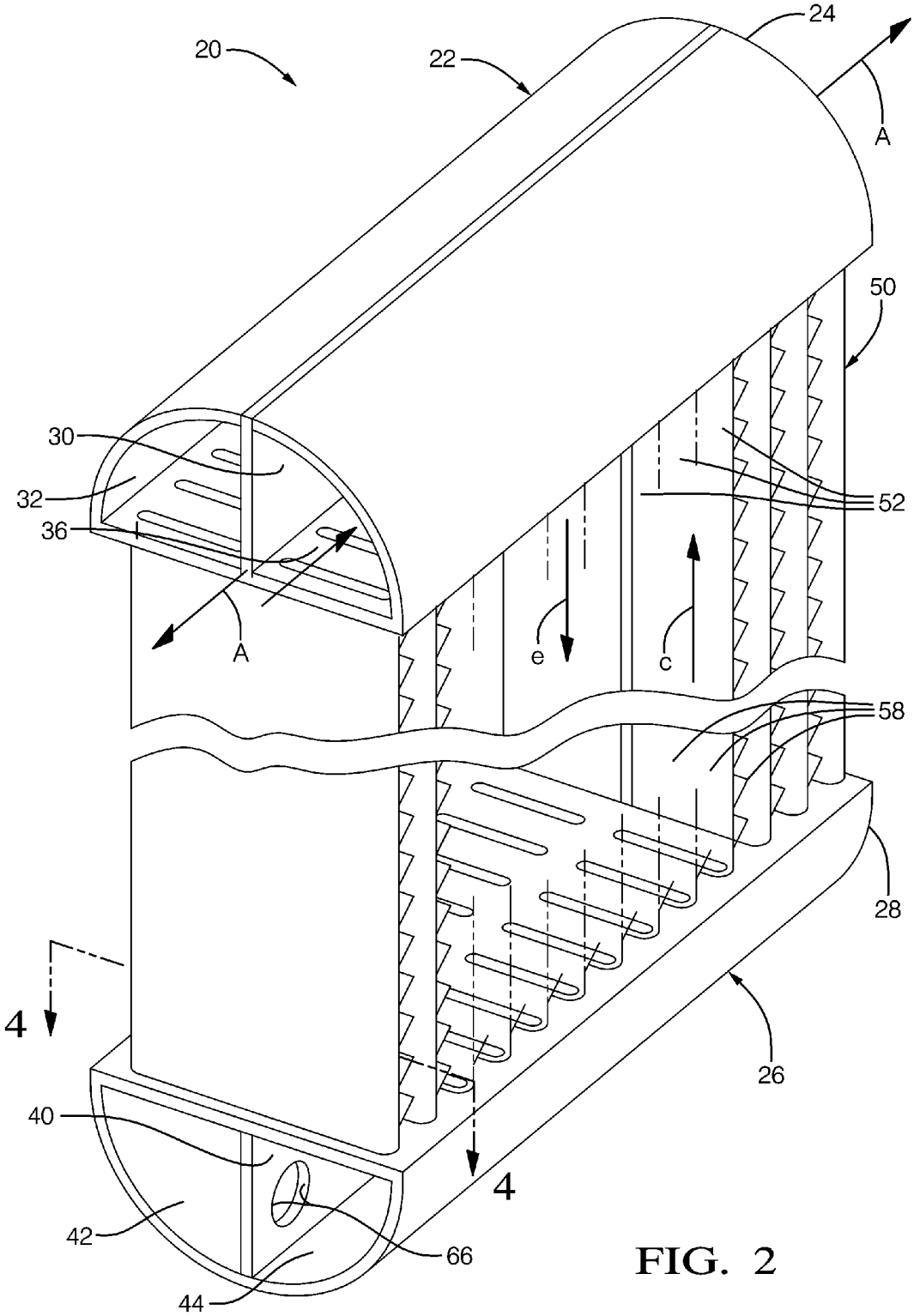
FIG. 2 is a fragmentary view of the subject invention as a two-pass heat exchanger assembly.
Figure 3:
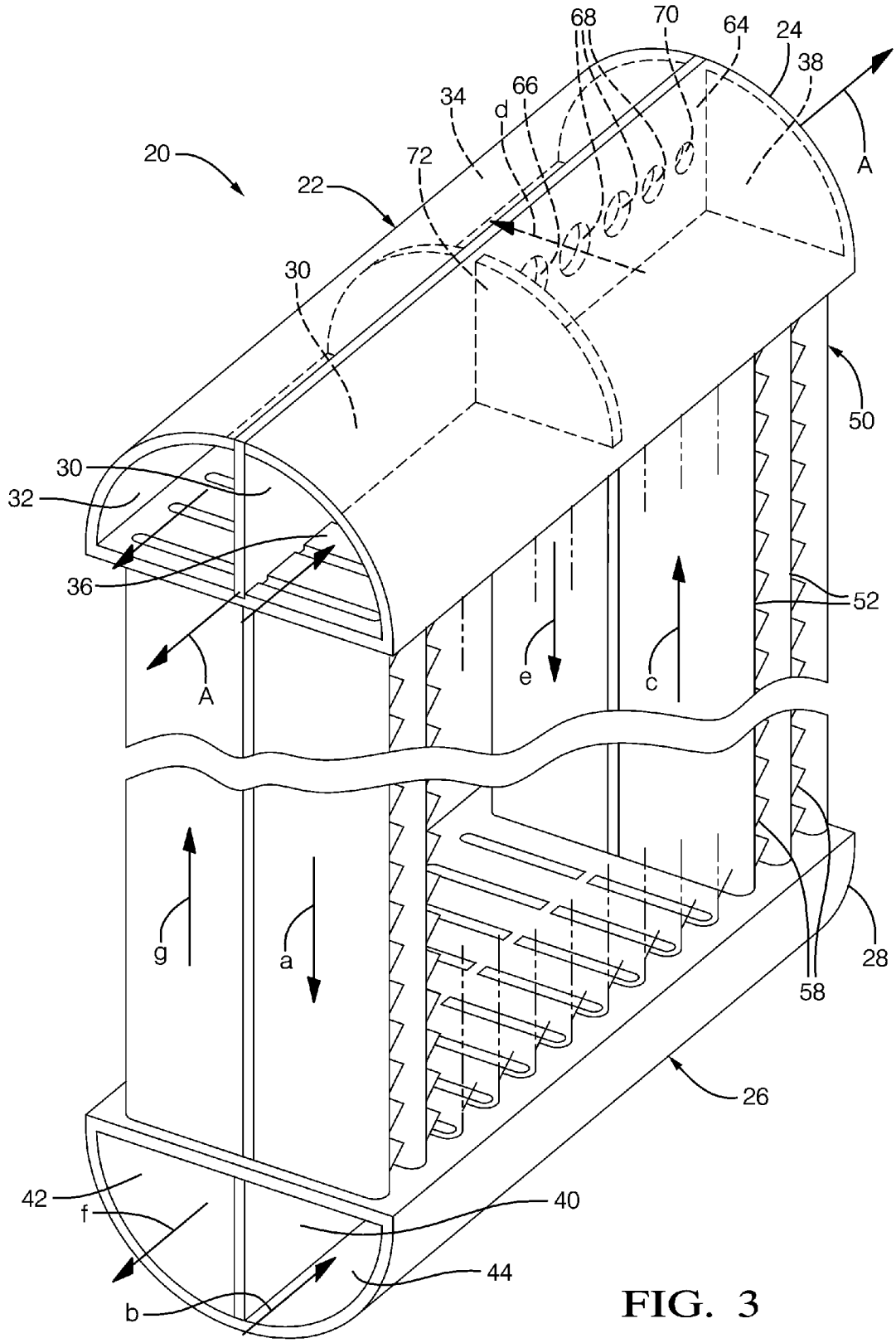
FIG. 3 is a fragmentary view of the subject invention as a four-pass heat exchanger assembly.

Referring to the Figures, wherein like numerals indicate corresponding parts throughout the several views, a heat exchanger assembly 20 for transferring heat between a coolant and a stream of air is generally shown in FIGS. 1-3. The heat exchanger assembly 20 could be a number of different kinds of heat exchangers, e.g. an evaporator, a condenser, a heat pump, etc.

The heat exchanger assembly 20 includes a first manifold 22, generally indicated, extending along an axis A between first manifold ends 24. A second manifold 26, generally indicated, extends between second manifold ends 28 in spaced and parallel relationship with the first manifold 22.

A first partition 30 is disposed in the first manifold 22 and extends axially along the first manifold 22 between the first manifold ends 24 to define a first upstream section 32, 34 on one side of the first partition 30 and a first downstream section 36, 38 on the other side of the first partition 30. A second partition 40 is disposed in the second manifold 26 and extends axially along the second manifold 26 between the second manifold ends 28 to define a second upstream section 42 on one side of the second partition 40 and a second downstream section 44 on the other side of the second partition 40. The first upstream section 32, 34 of the first manifold 22 is aligned with the second upstream section 42 of the second manifold 26, and the first downstream section 36, 38 of the first manifold 22 is aligned with the second downstream section 44 of the second manifold 26. It should be appreciated that either or both of the first and second manifolds 22, 26 could be two or more manifolds fused together to define the upstream and downstream sections. In this case, the area where the walls are joined together should be understood to be a partition.

The first manifold 22 includes an inlet 46 disposed on one of the first manifold ends 24 for receiving the coolant. In the exemplary embodiment, the inlet 46 is in fluid communication with the first downstream section 36, 38 of the first manifold 22. The first manifold 22 further includes an outlet 48 spaced from the inlet 46 in a transverse direction for dispensing the coolant. In the exemplary embodiment, the outlet 48 is in fluid communication with the first upstream section 32, 34 of the first manifold 22. It should be understood that the inlet and outlet 46, 48 could be disposed anywhere along either the first and second manifolds 22, 26 between the manifold ends depending on the application.

A core 50, generally indicated, is disposed between the first and second manifolds 22, 26 for conveying a coolant therebetween. The core 50 includes a plurality of tubes 52 extending in spaced and parallel relationship to one another between the first and second manifolds 22, 26 for receiving the stream of air in the transverse direction to transfer heat between the stream of air and the coolant in the tubes 52. In the exemplary embodiment, each of the tubes 52 has a cross-section presenting flat sides 54 extending in the transverse direction interconnected by round ends 56 with the flat sides 54 of adjacent tubes 52 spaced from one another by a fin space across the transverse direction.

A plurality of air fins 58 are disposed in the fin space between the flat sides 54 of the adjacent tubes 52 for transferring heat from the tubes 52 to the stream of air.

Figure 4:
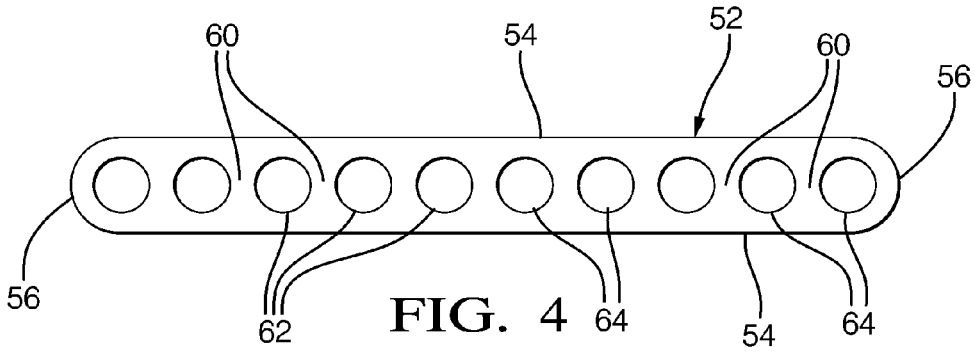
FIG. 4 is a cross-sectional view taken along line 4-4 of FIG. 3.

Each of the tubes 52 of the exemplary embodiments includes at least one tube divider 60, best seen in FIG. 4, for dividing each of the tubes 52 into at least one upstream flow path 62 and at least one downstream flow path 64. The upstream flow paths 62 of the tubes 52 establish fluid communication between the first and second upstream sections 32, 34, 42 of the first and second manifolds 22, 26, and the downstream flow paths 64 of the tubes 52 establish fluid communication between the first and second downstream sections 36, 38, 44 of the first and second manifolds 22, 26. The sum of the cross-sectional areas of the upstream flow paths 62 is defined as an upstream cross-sectional area, and the sum of the cross-sectional areas of the downstream flow paths 64 is defined as a downstream cross-sectional area.

One of the first and second partitions 30, 40 is further defined as a cross-over plate having at least one orifice 66, 68, 70 for establishing fluid communication between the upstream and downstream sections 42, 44 of the associated one of the first and second manifolds 22, 26. The orifices 66, 68, 70 can be produced using a shearing or any other known manufacturing process for creating holes. Additionally, the orifices 66, 68, 70 could be produced using a peeling process whereby material is not actually removed from the cross-over plate.

The sum of the cross-sectional areas of the orifices 66, 68, 70 of the cross-over plate defines a cross-over opening area for the flow of coolant between the upstream and downstream sections 34, 38, 42, 44 of the associated one of the first and second manifolds 22, 26. The heat exchanger assembly 20 of FIG. 2 is a two-pass heat exchanger assembly 20, and the second partition 40 is the cross-over plate 40. The heat exchanger assembly 20 of FIG. 3, is a four-pass heat exchanger assembly 20, and the first partition 30 is the cross-over plate 30. It should be appreciated that the heat exchanger assembly 20 can be designed for any number of passes, and the subject invention is not limited to the two and four pass heat exchanger assemblies 20 shown in FIGS. 2 and 3.

In the four-pass heat exchanger assembly 20 of FIG. 3, a manifold divider 72 is disposed in the first manifold 22 for partitioning the first upstream section 32, 34 into first and second upstream manifold passages 32, 34 and for partitioning the first downstream section 36, 38 into first and second downstream manifold passages 36, 38. As shown in FIG. 2, the orifices 66, 68, 70 are disposed on the opposite side of the manifold divider 72 from the inlet 46.

FIG. 3 includes arrows showing the path of travel of the coolant through the exemplary heat exchanger assembly 20, represented by the letters "a" through "g". In operation, the coolant enters the exemplary four-pass heat exchanger assembly 20 through the first downstream manifold passage 36 of the first manifold 22. The coolant then follows passes "a" through "c" sequentially through the downstream flow paths 64 to the second downstream section 44 of the second manifold 26 and back through the downstream flow paths 64 into the second downstream manifold passage 38 of the first manifold 22. The coolant passes through the orifices 66, 68, 70 of the cross-over plate 30 into the second upstream manifold passage 34 of the first manifold 22, as shown by the letter "d". Next, the coolant follows passes "e" through "g" sequentially through the upstream flow paths 62 of the tubes 52 to the second upstream section 42 of the second manifold 26 and back through the upstream flow paths 62 to the first upstream manifold passage 32 of the first manifold 22. The coolant is dispensed from the first upstream manifold passage 32 out of the four-pass heat exchanger assembly 20. It should be appreciated that the four-pass heat exchanger assembly 20 shown in FIG. 2 is only exemplary and that other variations of four-pass heat exchanger assemblies are included in the scope of the invention.

In the two-pass heat exchanger assembly 20 of FIG. 2, the second partition 40 in the second manifold 26 is the cross-over plate. In operation, the coolant enters the heat exchanger through the inlet 46 in the first downstream section 36, 38 of the first manifold 22. The coolant then flows through the downstream flow paths 64 of the tubes 52 to the second downstream section 44 of the second manifold 26. The coolant flows through the orifices 66, 68, 70 of the cross-over plate 40 in the second manifold 26 to the second upstream section 42. Next, the coolant flows through the upstream flow paths 62 of the tubes 52 to the first upstream section 32, 34 of the first manifold 22 where it is dispensed from the heat exchanger assembly 20 through the outlet 48. It should be appreciated that the coolant could also enter the heat exchanger assembly 20 in the first upstream section 32, 34 and exit the heat exchanger assembly 20 from the first downstream section 36, 38.

Figure 5A:
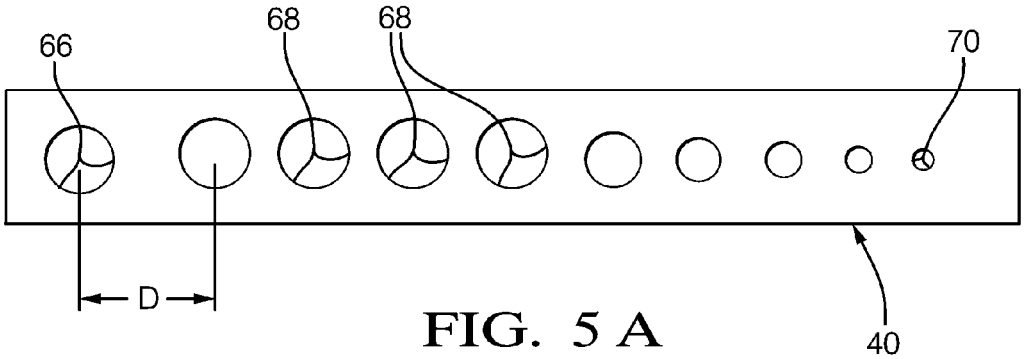
FIG. 5*a* is a top view a first embodiment of the cross-over plate according to the subject invention.
Figure 5B:
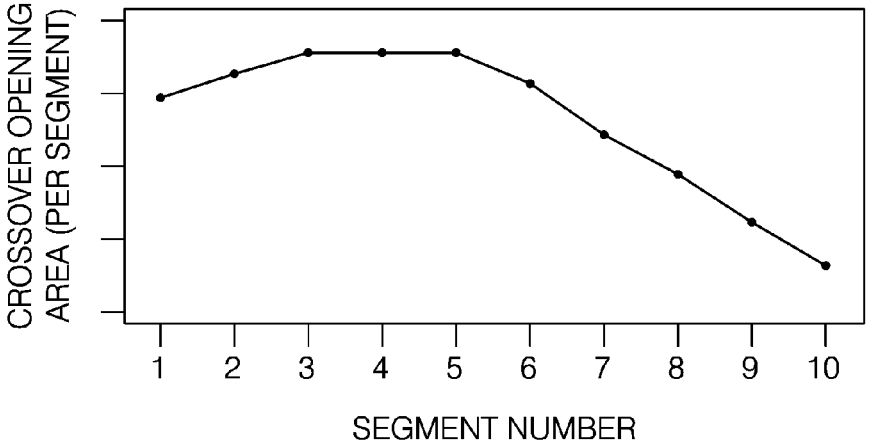
FIG. 5*b* is a plot of the cross-over opening area across the length of the first embodiment of the cross-over plate.

FIG. 5*a* shows a first embodiment of the cross-over plate 40 of the two-pass heat exchanger assembly 20. In the first embodiment, the cross-over plate 40 includes a plurality of orifices 66, 68, 70 spaced axially from one another by an orifice space D. The orifices 66, 68, 70 include a first orifice 66 disposed closest to the inlet 46, a plurality of middle orifices 68, and a last orifice 70 disposed farthest from the inlet 46. It should be understood that the term middle orifices 68 is meant to include any orifices 68 disposed between the first orifice 66 and the last orifice 70 and is not limited to only orifices disposed halfway between the manifold ends of the respective manifold 22, 24. The orifice space D between adjacent orifices 66, 68, 70 sequentially decreases from the first orifice 66 closest to the inlet 46 to the middle orifices 68 to define the continuously increasing cross-over opening area in the axial direction away from the inlet 46, as shown in FIG. 5*b*. Each of the segment numbers represents a unit of length of the cross-over plate with the segment numbers numerically increasing from the end closest to the inlet 46. The area of the orifices 66, 68, 70 sequentially decreases from the middle orifices 68 to the last orifice 70 farthest from the inlet 46. It should be appreciated that the orifice 66, 68, 70 pattern of FIG. 5*a* could also be used on the cross-over plate 30 of the four-pass heat exchanger assembly 20 of FIG. 3 and for heat exchangers with other pass arrangements.

Figure 6A:
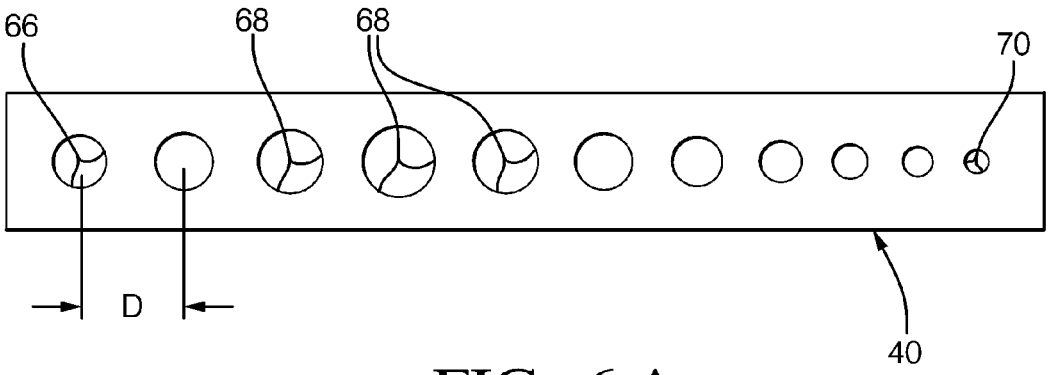
FIG. 6*a* is a top view a second embodiment of the cross-over plate according to the subject invention.
Figure 6B:
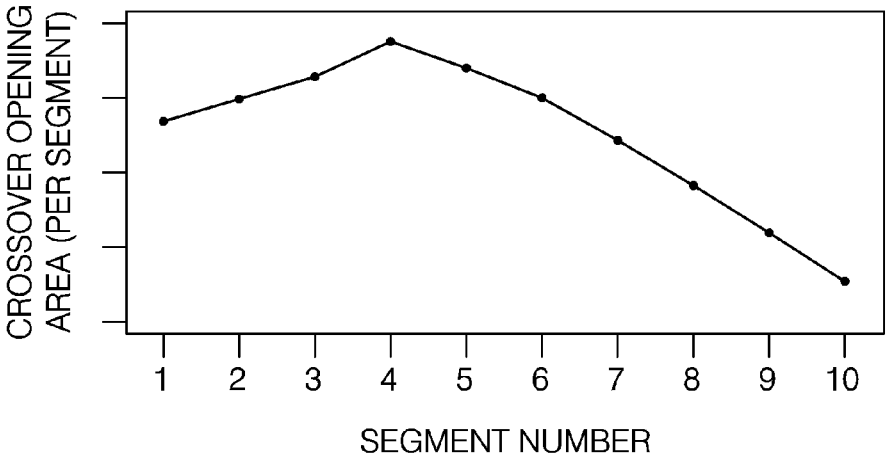
FIG. 6*b* is a plot of the cross-over opening area across the length of the second embodiment of the cross-over plate.

FIG. 6*a* shows a second embodiment of the cross-over plate 40 of the two-pass heat exchanger assembly 20. In the second embodiment, the cross-over plate 40 includes a plurality of orifices 66, 68, 70 spaced axially from one another by an orifice space D. The orifices 66, 68, 70 include a first orifice 66 disposed closest to the inlet 46, a middle orifice 68, and a last orifice 70 disposed farthest from the inlet 46. The area of the orifices 66, 68, 70 sequentially increases from the first orifice 66 closest to the inlet 46 to the middle orifice 68 to define the continuously increasing cross-over opening area in the axial direction away from the inlet 46, as shown in FIG. 6*b*. The area of the orifices 66, 68, 70 sequentially decreases from the middle orifice 68 to the last orifice 70 farthest from the inlet 46. It should be appreciated that the orifice 66, 68, 70 pattern of FIG. 6*a* could also be used on the cross-over plate 30 of the four-pass heat exchanger assembly 20 of FIG. 3 and for heat exchangers with other pass arrangements.

Figure 7A:
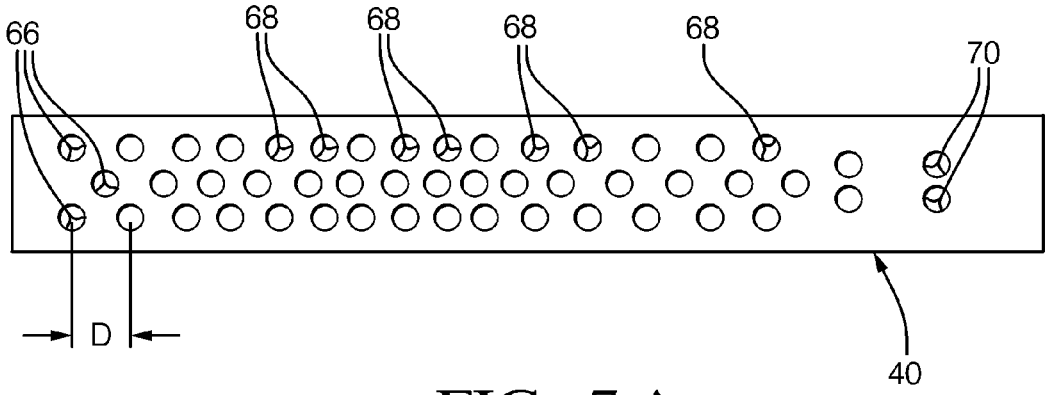
FIG. 7*a* is a top view a third embodiment of the cross-over plate according to the subject invention.
Figure 7B:
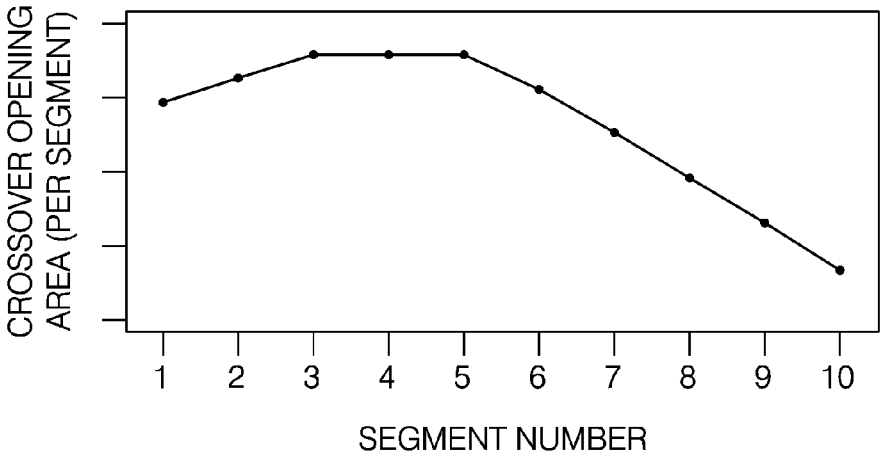
FIG. 7*b* is a plot of the cross-over opening area across the length of the third embodiment of the cross-over plate.

FIG. 7*a* shows a third embodiment of the cross-over plate 40 of the two-pass heat exchanger assembly 20. In the third embodiment, the cross-over plate 40 includes a plurality of orifices 66, 68, 70 disposed in three rows. All of the orifices 66, 68, 70 have the same area, and each row of orifices 66, 68, 70 includes a first orifice 66 disposed closest to the inlet 46, a plurality of middle orifices 68, and a last orifice 70 disposed farthest from the inlet 46. In each row, the orifice space D between adjacent orifices 66, 68, 70 sequentially decreases from a first orifice 66 closest to the inlet 46 to the middle orifices 68 to define the continuously increasing cross-over opening area in the axial direction away from the inlet 46, as shown in FIG. 7*b*. In each row, the orifice space D between adjacent orifices 66, 68, 70 sequentially increases from the middle orifices 68 to a last orifice 70 farthest from the inlet 46. It should be appreciated that the orifice 66, 68, 70 pattern of FIG. 7*a* could also be used on the cross-over plate 30 of the four-pass heat exchanger assembly 20 of FIG. 3 and for heat exchangers with other pass arrangements.

Figure 8A:
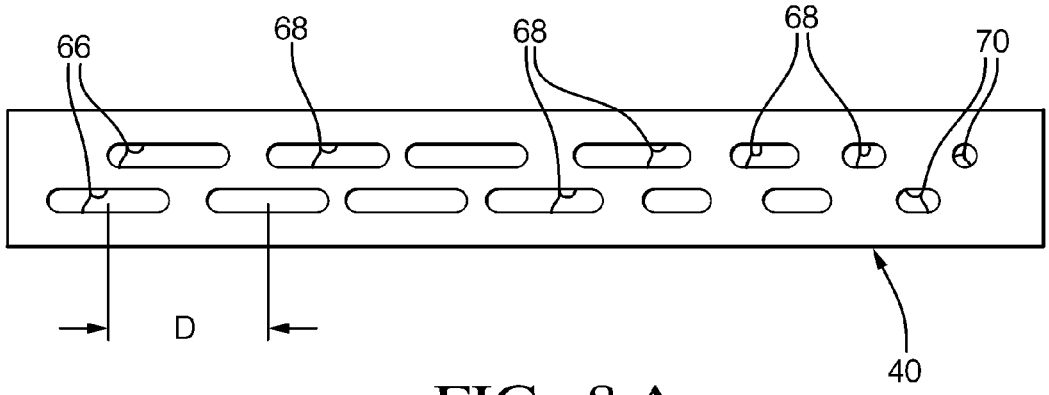
FIG. 8*a* is a top view a fourth embodiment of the cross-over plate according to the subject invention.
Figure 8B:
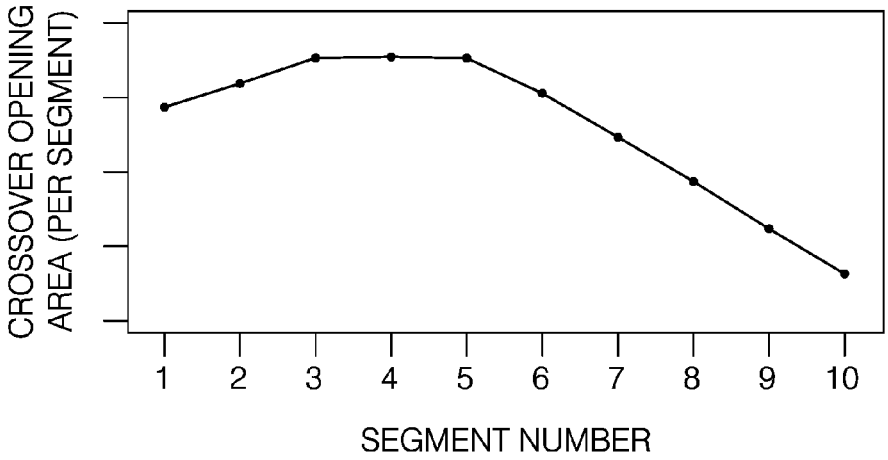
FIG. 8*b* is a plot of the cross-over opening area across the length of the fourth embodiment of the cross-over plate.

FIG. 8*a* shows a fourth embodiment of the cross-over plate 40 of the two-pass heat exchanger assembly 20. In the fourth embodiment, the cross-over plate 40 includes a plurality of orifices 66, 68, 70 disposed in two rows. In contrast to the first, second, and third embodiments, where the orifices 66, 68, 70 are all circular in shape, the orifices 66, 68, 70 of the fourth embodiment are oval shaped. It should be appreciated that the orifices 66, 68, 70 can present any shape to transfer the coolant between the upstream and downstream sections 34, 38, 42, 44 of the associated one of the first and second manifolds 22, 26. Each row of orifices 66, 68, 70 includes a first orifice 66 closest to the inlet 46, a plurality of middle orifices 68, and a last orifice 70 farthest from the inlet 46. In each row, the orifice space D between adjacent orifices 66, 68, 70 sequentially decreases from a first orifice 66 closest to the inlet 46 to the middle orifices 68 to define the continuously increasing cross-over opening area in the axial direction away from the inlet 46, as shown in FIG. 8*b*. In each row, the area of the orifices 66, 68, 70 sequentially decreases from the middle orifices 68 to the last orifice 70 farthest from the inlet 46. It should be appreciated that the orifice 66, 68, 70 pattern of FIG. 8*a* could also be used on the cross-over plate 30 of the four-pass heat exchanger assembly 20 of FIG. 3 and for heat exchangers with other pass arrangements.

Figure 9A:
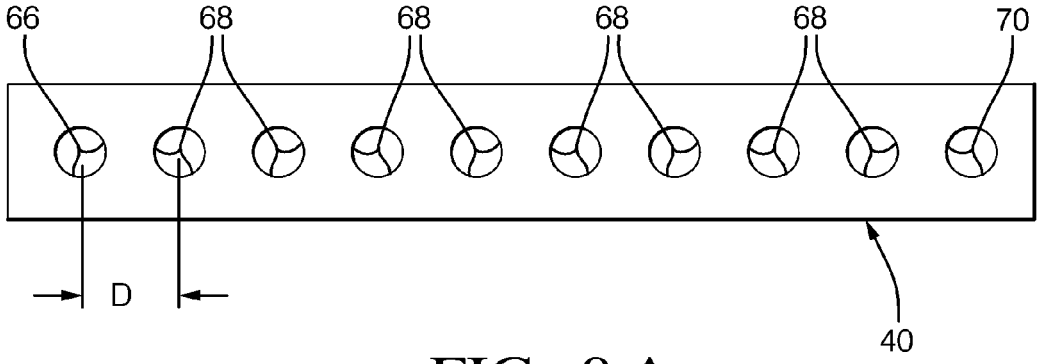
FIG. 9*a* is a top view a fifth embodiment of the cross-over plate according to the subject invention.
Figure 9B:
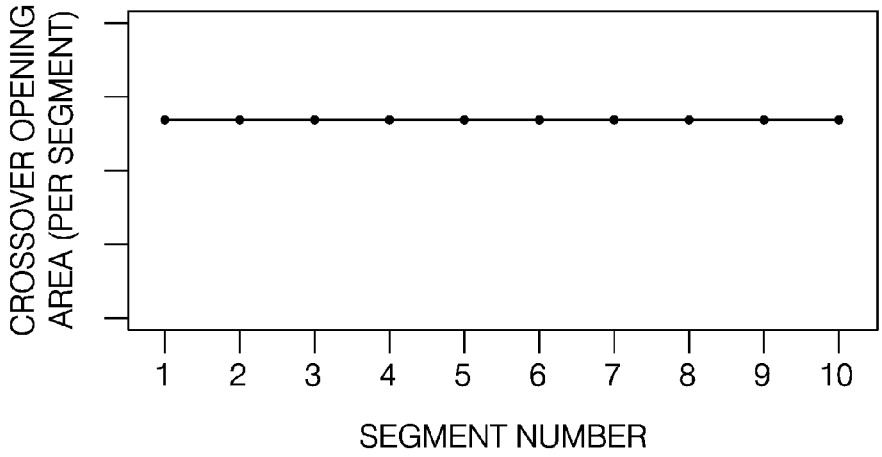
FIG. 9*b* is a plot of the cross-over opening area across the length of the fifth embodiment of the cross-over plate.

FIG. 9*a* shows a fifth embodiment of the cross-over plate 40, whereby the orifices 66, 68, 70 are all of uniform size and spacing. As shown in FIG. 9*b*, in the fifth embodiment, there is no change in the cross-over opening area of the cross-over plate 40. It should be appreciated that the orifice 66, 68, 70 pattern of FIG. 9*a* could also be used on the cross-over plate 30 of the four-pass heat exchanger assembly 20 of FIG. 3 and for heat exchangers with other pass arrangements.

As can be seen from FIGS. 5*a*-8*a*, the orifices 66, 68, 70 can have many different shapes and sizes. It should be appreciated that the orifices 66, 68, 70 can take any shape or size, and is not limited to those shown in FIGS. 5*a*-8*a*, so long as the cross-over opening area. Each of FIGS. 5*b*-8*b* shows a plot of the cross-over opening area across the cross-over plate with the cross-over plate being divided into a plurality of segments increasing in numerical order in the axial direction away from the inlet 46.

The sum of the cross-sectional areas of the upstream flow paths 62 adjacent to the orifices 66, 68, 70 of the cross-over plate is defined as an upstream cross-sectional area, and the sum of the cross-sectional areas of the downstream flow paths 64 adjacent to the orifices 66, 68, 70 of the cross-over plate is defined as a downstream cross-sectional area. In other words, in the four-pass heat exchanger assembly 20 of FIG. 2, only the flow paths 62, 64 disposed on the opposite side of the manifold divider 72 is included in calculation the upstream and downstream cross-sectional areas. In contrast, all of the upstream flow paths 62 are included in the calculation of the upstream cross-sectional area of the two-pass heat exchanger assembly 20 of FIG. 3, and all of the downstream flow paths 64 are included in the calculation of the downstream cross-sectional area of the two-pass heat exchanger assembly 20 of FIG. 2.

The cross-over opening area, described above, of the cross-over plate 30, 40 is 30% to 300% of the upstream cross-sectional area of the upstream flow paths 62. The 30% to 100% range is the most preferred range for automotive applications. This maximizes the efficiency of the heat exchanger assembly 20 without creating an undesirable pressure drop in the coolant flowing through the cross-over plate 30, 40. Although each of the embodiments show the orifices 66, 68, 70 either varying in gap, spacing or size along the axis A, it should be appreciated that both the gap, spacing and size of the orifices 66, 68, 70 could be constant along the axis A.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly for transferring heat between a coolant and a stream of air, comprising:

a first manifold;

a second manifold spaced from said first manifold;

a cross-over plate disposed in one of said first and second manifolds for dividing the associated manifold into an upstream section on one side of said cross-over plate and a downstream section on the other side of said cross-over plate;

said cross-over plate defining at least one orifice for establishing fluid communication between said upstream and downstream sections of the associated manifold;

a core extending between said first and second manifolds for transferring heat between the stream of air and the coolant;

said core including a plurality of tubes defining a plurality of upstream flow paths in fluid communication with said upstream section and a plurality of downstream flow paths in fluid communication with said downstream section;

said upstream flow paths defining an upstream cross-sectional area and said downstream flow paths defining a downstream cross-sectional area;

said at least one orifice of said cross-over plate defining a cross-over opening area; and wherein said cross-over opening area of said cross-over plate is 30% to 300% of said upstream cross-sectional area of said upstream flow paths;

wherein said cross-over plate includes a plurality of orifices;

wherein said plurality of orifices are spaced axially from one another;

wherein said first manifold extends along an axis between first manifold; ends and said first manifold defines an inlet on one of said first manifold ends; and wherein said spaced orifices sequentially increase in area from a first orifice nearest said inlet to a middle orifice to define a continuously increasing cross-over opening area in said axial direction away from said inlet.

2. The assembly as set forth in claim 1 wherein said spaced orifices sequentially decrease in area from said middle orifice to a last orifice being farthest from said inlet.

3. A heat exchanger assembly for transferring heat between a coolant and a stream of air comprising:

a first manifold extending along an axis between first manifold ends;

a second manifold extending between second manifold ends in spaced and parallel relationship with said first manifold;

a core disposed between said first and second manifolds for conveying a coolant therebetween and for transferring heat between the coolant and the stream of air;

said core including a plurality of tubes extending in spaced and parallel relationship with one another between said first and second manifolds;

each of said tubes having a cross-section presenting flat sides interconnected by round ends;

a plurality of air fins disposed in said fin space between said flat sides of said adjacent tubes for transferring heat from the coolant in said tubes to the stream of air;

a first partition disposed in said first manifold and extending axially along said first manifold between said first manifold ends to define an first upstream section on one side of said first partition and a first downstream section on the other side of said first partition;

a second partition disposed in said second manifold and extending axially along said second manifold between said second manifold ends to define a second upstream section on one side of said second partition and a second downstream section on the other side of said second partition;

each of said tubes including a plurality of tube dividers for dividing each of said tubes into a plurality of upstream flow paths for establishing fluid communication between said first and second upstream sections and a plurality of downstream flow paths for establishing fluid communication between said first and second downstream sections;

said upstream flow paths defining an upstream cross-sectional area and said downstream flow paths defining a downstream cross-sectional area;

said first manifold defining an inlet on one of said first manifold ends for receiving the coolant;

said inlet being in fluid communication with said first downstream section of said first manifold;

said first manifold including an outlet paced from said inlet for dispensing the coolant out of said heat exchanger assembly;

said outlet being in fluid communication with said first upstream section of said first manifold;

one of said first and second partitions being further defined as a cross-over plate having at least one orifice for establishing fluid communication between said upstream and downstream sections of the associated manifold;

said at least one orifice of said cross-over plate defining a cross-over opening area for the flow of coolant between said upstream and downstream sections of the associated one of said first and second manifolds;

said cross-over opening area continuously increasing along said axis toward the one of said manifold ends away from said inlet; and wherein said cross-over opening area is 30% to 300% of said upstream cross-sectional area; wherein said at least one orifice further includes a plurality of orifices spaced axially from one another; said spaced orifices sequentially increasing in area from a first orifice nearest said inlet to a middle orifice to define said continuously increasing cross-over opening area in said axial direction away from said inlet; and said spaced orifices sequentially decreasing in area from said middle orifice to a last orifice farthest from said inlet.

* * * * *